United States Patent [19]

Kubota

[11] Patent Number: 4,464,896

[45] Date of Patent: Aug. 14, 1984

[54] SYSTEM FOR SUPPLYING SECONDARY AIR FOR AN INTERNAL COMBUSTION ENGINE

[75] Inventor: Masaharu Kubota, Musashino, Japan

[73] Assignee: Fuji Jukogyo Kabushiki Kaisha, Tokyo, Japan

[21] Appl. No.: 359,542

[22] Filed: Mar. 18, 1982

[30] Foreign Application Priority Data

Apr. 11, 1981 [JP] Japan ..... 56-54720

[51] Int. Cl.[3] ..... F02B 75/10; F01N 3/22

[52] U.S. Cl. ..... 60/290; 60/284; 60/293

[58] Field of Search ..... 60/284, 289, 290, 293

[56] References Cited

U.S. PATENT DOCUMENTS

| | | | |
|---|---|---|---|
| 3,653,212 | 4/1972 | Gast et al. | 60/290 |
| 3,927,523 | 12/1975 | Shioyama | 60/284 |
| 3,986,352 | 10/1976 | Casey | 60/289 |
| 4,099,377 | 7/1978 | Yoshimura | 60/289 |
| 4,147,033 | 4/1979 | Miura | 60/290 |
| 4,169,352 | 10/1979 | Iwata | 60/290 |

FOREIGN PATENT DOCUMENTS

| | | | |
|---|---|---|---|
| 25323 | 2/1979 | Japan | 60/289 |

*Primary Examiner*—Douglas Hart

*Attorney, Agent, or Firm*—Martin A. Farber

[57] ABSTRACT

A system for supplying secondary air for an emission control system of an internal combustion engine having a catalytic converter. The system comprises a secondary air conduit communicated with an exhaust port of the engine, a reed valve provided in the secondary air conduit for preventing the counterflow. The inlet of the reed valve is communicated with the atmosphere for inducting secondary air into the exhaust passage. A valve is provided for opening the inlet of the reed valve, and a valve actuator for actuating the valve. An engine temperature sensor is provided for producing an output signal when the temperature of the engine is below than a predetermined temperature. An electric circuit is operated in response to the output signal of the engine temperature sensor. A timer including a switch is adapted to be operated by the output signal of the engine temperature sensor for closing the switch for a predetermind time for operating the electromagnetic valve to operate the valve actuator for opening the inlet, whereby secondary air is sucked into the exhaust passage.

8 Claims, 1 Drawing Figure

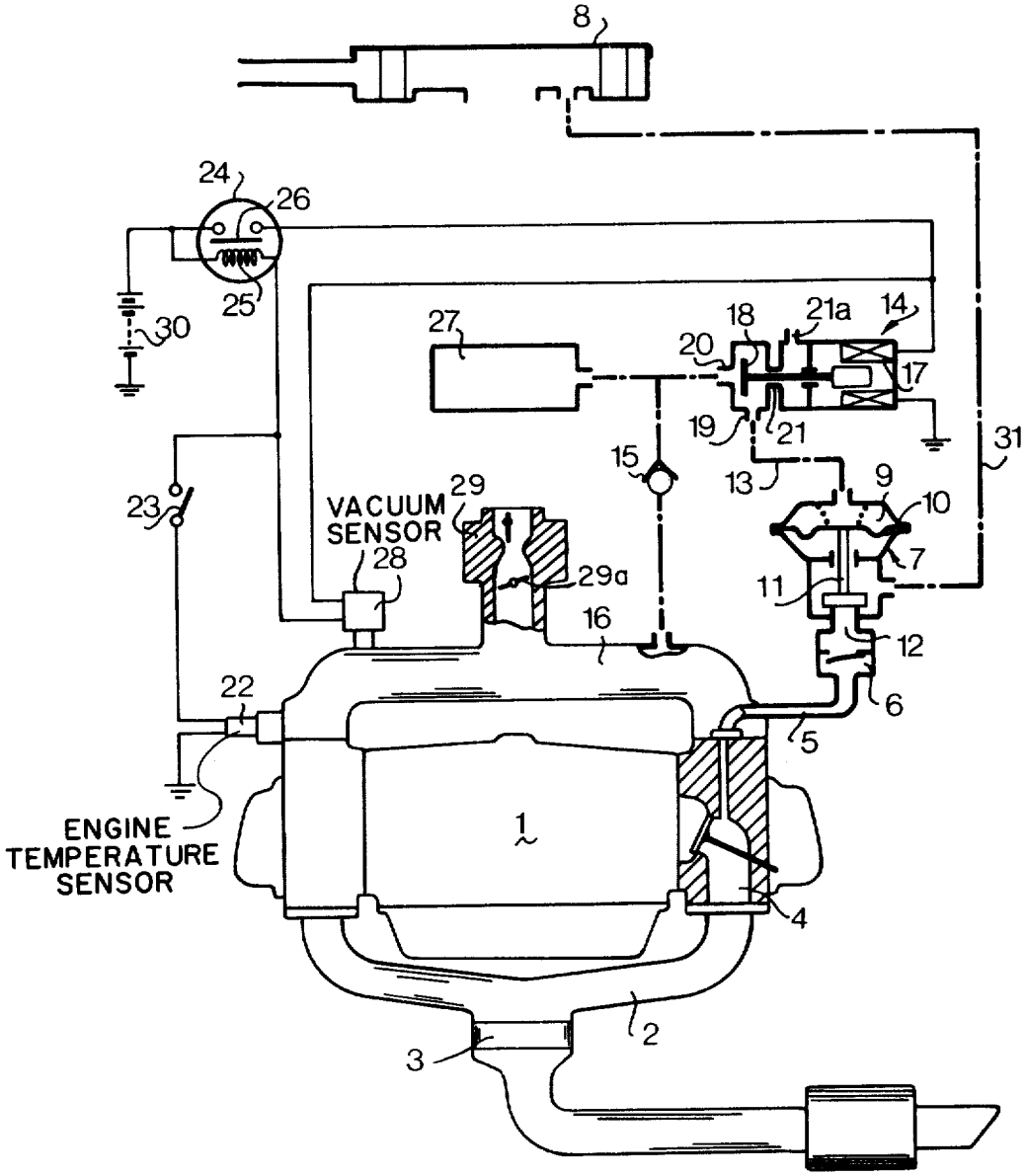
8
24
26
25
30
27
18
21a
14
20
17
19
21
31
15
13
9
10
23
VACUUM SENSOR
29
28
29a
7
11
16
12
22
6
5
ENGINE TEMPERATURE SENSOR
1
4
2
3

SYSTEM FOR SUPPLYING SECONDARY AIR FOR AN INTERNAL COMBUSTION ENGINE

BACKGROUND OF THE INVENTION

The present invention relates to a system for controlling secondary air supply for an exhaust emission control system of an internal combustion engine.

An exhaust emission control system provided with a catalytic converter of the three-way type is known. In such a system, the air-fuel ratio of a mixture to be supplied to the engine is controlled to stoichiometry by a feedback control system having an $O_2$-sensor for detecting the oxygen concentration of the exhaust gases. The exhaust emission control system is effective in controlling the emission at a steady operation of the engine. However, the $O_2$- sensor fails to detect the oxygen concentration during cold engine operation and the three-way catalyst does not effect sufficient catalysis of the exhaust gas constituents. Since, generally, a choke valve of the engine is closed, a rich air-fuel mixture is supplied to the engine. Thus, a large amount of unburned gases is discharged during cold engine operation.

On the other hand, during rapid acceleration by a wide open throttle or heavy load operation of the engine, the air-fuel mixture is enriched, which also causes the discharge of exhaust gases containing a large amount of unburned constituents.

U.S. Pat. No. 3,653,212 discloses a secondary air supply system which consists of a reed valve and a valve responsive to the intake pressure with the aid of a diaphragm. However, this system is not to prevent the excessive enrichment during cold engine operation, but to prevent back-firing during engine deceleration.

SUMMARY OF THE INVENTION

The object of the present invention is to provide a system for supplying the secondary air to the engine during cold engine operation, rapid acceleration and heavy load operation for reducing the amount of unburned gas discharge.

According to the present invention, there is provided a system for supplying secondary air for an emission control system of an internal combustion engine having an induction passage, an exhaust passage, and a catalytic converter, comprising a secondary air conduit communicated with the exhaust passage at a position upstream of the catalytic converter; first valve means provided in the secondary air conduit for preventing the counterflow; the first valve means having an inlet communicated with the atmosphere for inducting secondary air into the exhaust passage; second valve means for opening the inlet of the first valve means; valve actuator means for actuating the secondary valve means; engine temperature detecting means for producing an output signal when the temperature of the engine is below a predetermined temperature; electric circuit means responsive to the output signal of the engine temperature detecting means. A timer including a switch is adapted to be operated by the output signal of the engine temperature detecting means for closing the switch for a predetermined time for operating the electromagnetic valve effective to operate the valve actuator means for opening the inlet.

The other objects and features are explained more in detail with reference to the accompanying drawings.

BRIEF DESCRIPTION OF DRAWING

The single drawing shows schematically a system according to the present invention.

DETAILED DESCRIPTION OF THE PREFERRED EMBODIMENT

An internal combustion engine 1 shown in the drawing is a horizontally opposed-cylinder type engine and has a bifurcated exhaust pipe 2. A three-way catalytic converter 3 is disposed in the exhaust pipe 2 at the confluent portion. A secondary air conduit 5 is communicated with an exhaust port 4 at a position upstream of the catalytic converter where vacuum caused by exhaust gas pulsation is particularly effected. A reed valve 6 is provided in the secondary air conduit 5 for preventing counterflow thereby inducting secondary air into the exhaust port 4. An inlet port 12 of the reed valve 6 is communicated with an air cleaner 8 through a secondary air pipe 31. A valve actuator 7 comprises a vacuum chamber 9 and a diaphragm 10 defining the vacuum chamber 9. The diaphragm 10 is connected to a valve body 11 for closing the inlet port 12 of the reed valve 6.

The vacuum chamber 9 is communicated with an intake manifold 16 by a vacuum conduit 13 passing through an electromagnetic valve 14 and a check valve 15 which prevents counterflow. The electromagnetic valve 14 comprises an electric coil 17 for shifting a valve body 18, a port 19, a vacuum port 20 and an atmosphere port 21 communicating with a port **21*a* open to the atmosphere. The valve body 18 is adapted to close the atmosphere port 21 and open the vacuum port 20 and vice versa. The check valve 15 is communicated with the intake manifold 16 at a position downstream of a carburetor 29 and operates to maintain the vacuum in the vacuum chamber 9. A vacuum tank 27 (constituting a vacuum accumulator) is connected between the electromagnetic valve 14 and the check valve 15**.

An engine temperature sensor 22 is attached to the engine 1 for sensing the temperature of the cooling water of the engine. The sensor 22 is adapted to be on when the temperature of the cooling water is below a predetermined temperature. The sensor 22 is electrically connected to a coil 25 of a timer 24 via a switch 23 which is operated together with an ignition switch (not shown). The timer 24 is so arranged that when the coil 25 is excited, a switch 26 is closed for a predetermined period of time. The switch 26 is connected between a battery 30 and the coil 17 of the electromagnetic valve 14. A vacuum sensor 28 is provided on the intake manifold 16 downstream of the carburetor 29 for detecting rapid acceleration and heavy load operation. The vacuum sensor 28 is also connected to the coil 25 and connected to the coil 17 of the electromagnetic valve 14.

In cold engine operation, the engine temperature sensor 22 is on. Since the switch 23 is closed during the engine operation, the coil 25 of the timer 24 is excited and the switch 26 is closed. Thus, the coil 17 of the electromagnetic valve 14 is energized, so that the valve body 18 is drawn to the coil 17 to open the vacuum port 20 and to close the atmosphere port 21. Thus, the vacuum in the intake manifold 16 opens the check valve 15 and causes a decrease in the pressure in the vacuum chamber 9 of the actuator 7. The diaphragm 10 is deflected by the vacuum in the vacuum chamber 9 to open the inlet port 12. Thus, the secondary air is sucked into the exhaust port 4 from the air cleaner 8 passing through the reed valve 6.

The reed valve 6 is periodically opened by the vacuum caused by the pulsations of the exhaust gases. The induced secondary air is mixed with the exhaust gases. The induced gases are oxidized in the passages 4 and 2 before the catalytic converter 3. The exhaust gases enter the catalytic converter 3 in which the exhaust gases are further oxidized. The exhaust gases including a large amount of unburned constituents are effectively oxidized in the catalytic converter 3 with the aid of the secondary air for a predetermined time set by the timer 24. After the predetermined time, the switch 26 is opened and the coil 17 is de-energized. Thus, the valve body 18 is shifted to the left, so that the vacuum chamber 9 of the valve actuator 7 is communicated with the atmosphere through ports 19, 21, 21*a*. Accordingly, the port 12 is closed to stop supplying the secondary air. The set time of the timer 24 is selected to a period for warming up in normal cold engine operation.

On the other hand, the vacuum in the intake manifold 16 is considerably high during the idling operation because the inlet of the intake manifold is throttled by the throttle valve 29*a* in an idling position. The high vacuum is stored in the vacuum tank 27 via the check valve 15. When the throttle valve is widely opened for rapid acceleration or heavy load operation, the vacuum in the intake manifold 16 is decreased to turn on the vacuum sensor 28. As a result, the coil 17 is energized regardless of the on or off condition of the switch 26. Accordingly, the vacuum stored in the vacuum tank 27 is applied to the vacuum chamber 9 of the actuator 7 to open the port 12, causing the supply of the secondary air into the exhaust port 4 for decreasing the unburned constituents. When the vacuum sensor 28 is turned off, the electromagnetic valve 14 is de-energized and the port 12 is closed. For detecting the rapid acceleration and heavy load operation, other detecting means such as for example a throttle position sensor may be employed.

In a the steady operation of the engine, the air-fuel ratio of the mixture to be supplied to the engine by the carburetor 29 is controlled to stoichiometry by a known feedback control system (not shown). Thus, the exhaust gases are effectively oxidized by the catalytic converter 3.

From the foregoing, it will be understood that the present invention provides a system which supplies the secondary air into the exhaust passage during the cold engine operation, rapid acceleration and heavy load operation, whereby the exhaust gases which include a large amount of unburned constituents may be effectively oxidized to reduce the amount of harmful constituents.

While the presently preferred embodiment of the present invention has been shown and described, it is to be understood that this disclosure is for the purpose of illustration and the various changes and modifications may be made without departing from the spirit and scope of the invention as set forth in the appended claims.

What is claimed is:

1. A system for supplying secondary air for an emission control system of an internal combustion engine having an induction passage, an exhaust passage, and a catalytic converter, comprising:

a secondary air conduit communicated with said exhaust passage at a position upstream of said catalytic converter;

first valve means provided in said secondary air conduit for preventing counterflow, said first valve means having an inlet communicated with the atmosphere for inducing secondary air into said exhaust passage;

second valve means for opening said inlet of said first valve means;

valve actuator means for actuating said second valve means, said valve actuator means comprising a vacuum chamber and a diaphragm defining said vacuum chamber and connected to said second valve means;

engine temperature detecting means for producing an output signal when the temperature of said engine is below a predetermined temperature;

electric circuit means responsive to said output signal of said engine temperature detecting means effective to operate said valve actuator means for opening said inlet, said electric circuit means including an electromagnetic valve for communicating said vacuum chamber with said induction passage for applying the vacuum in the induction passage to said vacuum chamber, and a timer including a switch adapted to be operated by said output signal of said engine temperature detecting means for closing the switch for a predetermined time for operating said electromagnetic valve.

2. The system for supplying secondary air for an emission control system of an internal combustion engine according to claim 1, wherein said first valve means is a reed valve.

3. The system for supplying secondary air for an emission control system of an internal combustion engine according to claim 1 further comprising a vacuum accumulator communicated with said induction passage through another conduit together with said electromagnetic valve, means comprising a check valve provided in said another conduit for accumulating vacuum in the vacuum accumulator, a sensor means for detecting rapid acceleration and heavy load operation of said engine respectively and for producing an output signal for operating said electromagnetic valve independent of the condition of said timer.

4. The system for supplying secondary air for an emission control system of an internal combustion engine according to claim 3, wherein said sensor means is a vacuum sensor communicating with said induction passage.

5. The system for supplying secondary air for an emission control system of an internal combustion engine according to claim 1, further comprising switch means in said electric circuit for connecting said engine temperature detecting means and said switch when the engine is running.

6. A system for supplying secondary air for an emission control system of an internal combustion engine having an induction passage, an exhaust passage, and a catalytic converter, comprising:

a secondary air conduit communicating with the atmosphere and with said exhaust passage at a position upstream of said catalytic converter;

valve means disposed in said secondary air conduit and when actuated for allowing secondary air to be induced from the atmosphere through said secondary air conduit into said exhaust passage and for preventing counterflow, respectively;

valve actuator means for actuating said valve means;

engine temperature detecting means for producing an output signal when the temperature of said engine is below a predetermined temperature;

electric circuit means responsive to said output signal of said engine temperature detecting means for operating said valve actuator means for actuating said valve means, and a timer including a switch adapted to be operated by said output signal of said engine temperature detecting means for closing the switch for a predetermined time for operating said valve actuator means.

7. The system for supplying secondary air for an emission control system of an internal combustion engine according to claim 6 further comprising a sensor means for detecting rapid acceleration and heavy load operation of said engine respectively and for producing an output signal for operating said valve means independent of the condition of said timer.

8. The system for supplying secondary air for an emission control system of an internal combustion engine according to claim 6, wherein said valve means includes a reed valve.

* * * * *